US005738599A

United States Patent [19]

Malwitz

[11] Patent Number: 5,738,599

[45] Date of Patent: Apr. 14, 1998

[54] BATTING PRACTICE DEVICE WITH TIRE

[76] Inventor: Lonnie D. Malwitz, 9840 250th St. W., Lakeville, Minn. 55044

[21] Appl. No.: 505,698

[22] Filed: Jul. 21, 1995

Related U.S. Application Data

[63] Continuation-in-part of Ser. No. 368,864, Jan. 5, 1995, abandoned, which is a continuation-in-part of Ser. No. 153,320, Nov. 16, 1993, abandoned, which is a continuation-in-part of Ser. No. 988,772, Dec. 10, 1992, Pat. No. 5,271,618.

[51] Int. Cl.[6] ..... A63B 69/40

[52] U.S. Cl. ..... 473/423

[58] Field of Search ..... 273/29 R, 26 R; 473/422, 423, 440, 441, 442, 443, 446, 147, 149, 151, 154

[56] References Cited

U.S. PATENT DOCUMENTS

| | | | |
|---|---|---|---|
| 2,696,383 | 12/1954 | Noftsinger | 473/441 |
| 3,830,494 | 8/1974 | Biskup | 273/26 E |
| 4,010,950 | 3/1977 | Viscokis | 273/26 E |
| 4,050,694 | 9/1977 | Domroski | 273/26 E |
| 4,093,234 | 6/1978 | Barton | 273/200 R |
| 4,095,798 | 6/1978 | Marple | 273/200 R |
| 4,097,044 | 6/1978 | Miniere | 473/441 |
| 4,451,036 | 5/1984 | Sinclair | 273/26 R |
| 4,533,138 | 8/1985 | Rodriguez | 273/26 R |
| 4,592,540 | 6/1986 | Segedahl | 473/422 |
| 4,664,375 | 5/1987 | Tetreault | 273/26 E |
| 4,702,866 | 10/1987 | Krueger | 264/46.4 |
| 4,793,612 | 12/1988 | Hammond | 273/26 E |
| 4,828,262 | 5/1989 | Henley | 273/26 E |
| 4,898,385 | 2/1990 | Love | 273/26 E |
| 5,000,450 | 3/1991 | Beintema | 273/26 E |
| 5,503,391 | 4/1996 | Stelly | 273/26 R |

FOREIGN PATENT DOCUMENTS

| | | |
|---|---|---|
| 2401055 | 7/1975 | Germany . |
| 493661 | 10/1938 | United Kingdom . |

*Primary Examiner*—Theatrice Brown

*Attorney, Agent, or Firm*—Palmatier, Sjoquist, Helget & Voigt, P.A.

[57] ABSTRACT

A batting practice device is attachable to any of various existing permanent fixtures. The device includes a mounting bracket attachable to the fixture, the bracket supporting a receiving tube. The tube has two opposing openings for interlockably receiving a rod with a portion extending from the bracket in a cantilevered horizontal fashion. A first metal support plate is transversely mounted on the rod portion extending from the bracket. A tire has a tread face and an inside wall. The tread face abuts the metal plate. A second metal support plate is located on the inside wall aligned with the first plate as to sandwich and support the tire for hitting the tire with a bat.

5 Claims, 6 Drawing Sheets

BATTING PRACTICE DEVICE WITH TIRE

This application is a continuation-in-part of prior filed application Ser. No. 08/368,864, filed on Jan. 5, 1995, (ABND) which is a continuation-in-part of prior filed application Ser. No. 08/153,320, filed on Nov. 16, 1993, now abandoned, which is a continuation-in-part of application Ser. No. 07/988,772 filed on Dec. 10, 1992, which is now issued U.S. Pat. No. 5,271,618, issued on Dec. 21, 1993.

BACKGROUND OF THE INVENTION

This invention relates to a batting practice device, and more particularly, to an improved batting practice device with fire that is more inexpensive, durable, safe and long lived than other prior batting practice device.

In general, such batting practice devices are a necessary tool to permit a ball player to practice daily, if desired, hitting a ball within the hittable strike zone for the baseball player. These devices permit the user to train his body, arms and eyes. An observer may coach the user with respect to the proper body stance and balance in learning and adapting the proper body mechanics for batting. With the aid of batting practice devices, an individual can learn to transfer his weight into hitting the ball, to slug the ball hard, to become a switch hitter and to develop confidence in a sense to see, hear and feel the crisp hard hit of a correctly batted ball.

There are, of course, many baseball and softball batting practice devices known in the prior art. The prior art devices are not completely satisfactory in all respects and do not provide the same flexibility, portability and overall advantages of the present invention. Such prior art devices are quite extravagant and complex rendering them quite expensive and not readily available to the average young baseball player for practice at home. Other types of batting devices appear somewhat flimsy and not durable thereby having a shortened life when compared to the present invention.

There is a need for a batting practice device that is easy to manufacture and relatively inexpensive, thereby making it available to young players as well as the older avid baseball and softball player enthusiast. The device must be of a durable construction as to not deteriorate or wear out upon the practicing hitters repeated inability to not directly hit the center of the device, but to hit other parts of the device. The device, therefore, must not only be durable but be of a long life construction that can take the hard abuse that the a training and learning baseball player may inflict on the batting practice device.

SUMMARY OF THE INVENTION

A batting practice device is attachable to any of various existing permanent fixtures. The device includes a mounting bracket attachable to the fixture, the bracket supporting a receiving tube. The tube has two opposing openings for interlockably receiving a rod with a portion extending from the bracket in a cantilevered horizontal fashion. A first metal support plate is transversely mounted on the rod portion extending from the bracket. A tire has a tread face and an inside wall. The tread face abuts the metal plate. A second metal support plate is located on the inside wall aligned with the first plate as to sandwich and support the tire for hitting the tire with a bat.

A principle object and advantage of the present invention is that it is of an extremely durable and long lived construction while yet remaining relatively simple, easy and inexpensive to manufacture.

Another object and advantage of the present invention is that the device can be mounted on any of a variety of permanent fixtures, such as a fence, post, building, tree or wall.

Another object and advantage is that the elongate mount bar of the device absorbs the impact, shock, vibration and energy forces transferred through the device which otherwise would be passed on through to the permanent fixture.

Another object and advantage of the present invention is that all or at least portions of the device may be removed from the permanent fixture for safe keeping or transfer to another location.

Another object and advantage is that a bat hitting the tire simulates a solidly hit ball.

Another object and advantage is that the degree of hitting force may be measured by a bladder in the tire connected to a gauge.

Other objects and advantages will become readily apparent upon review of the following figures, specification and appended claims.

Figures 9, 13:
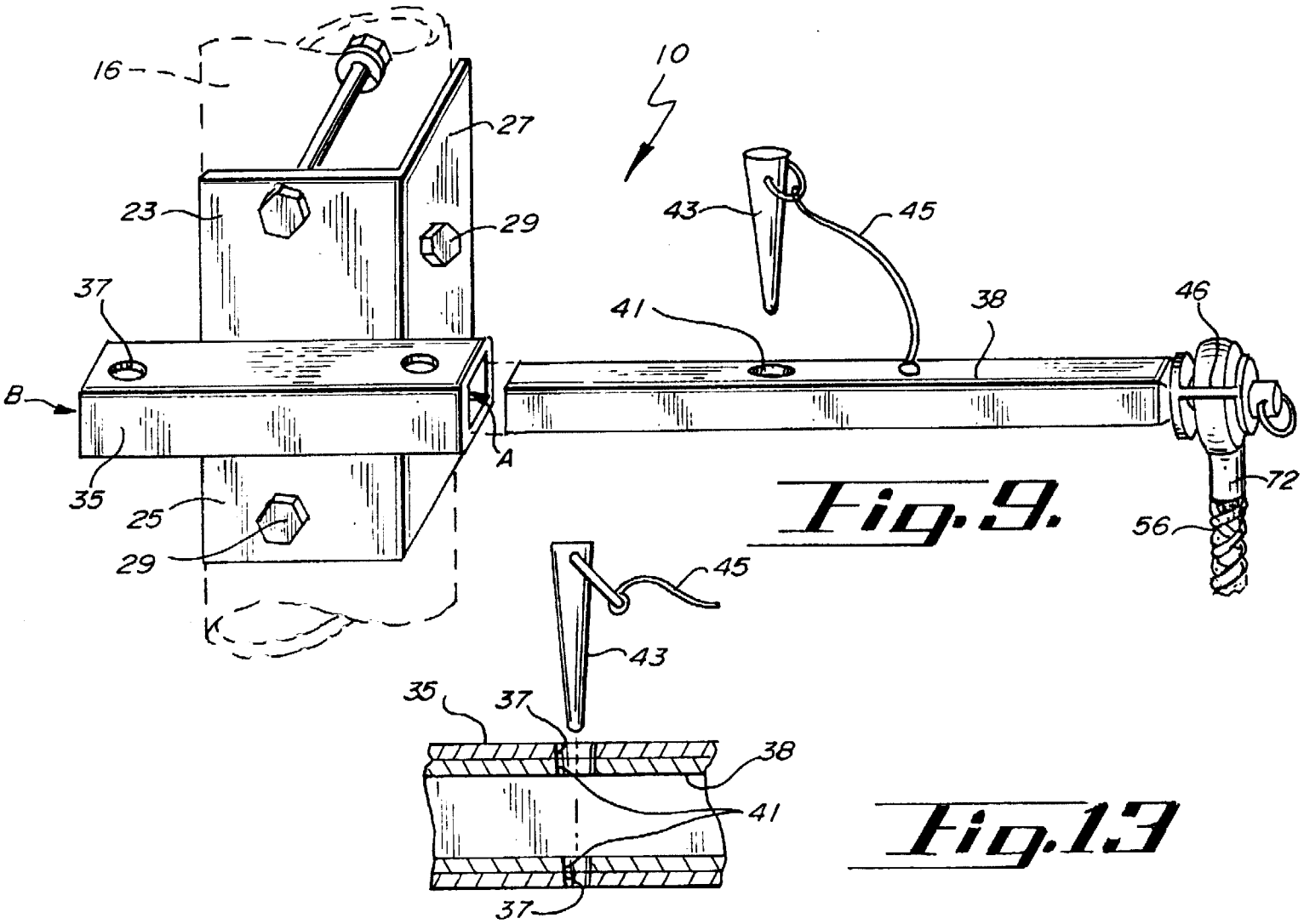
FIG. 9, is a perspective view of a modified mounting structure for the device.
Figure 10:
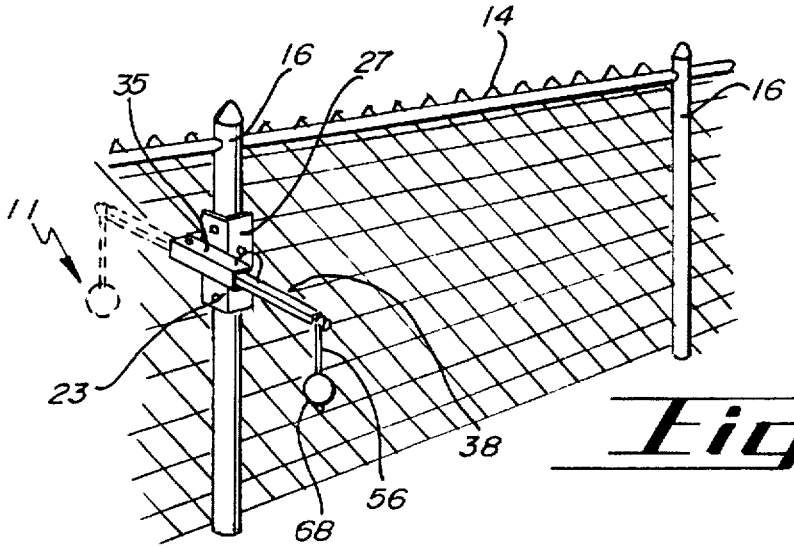
Figure 11:
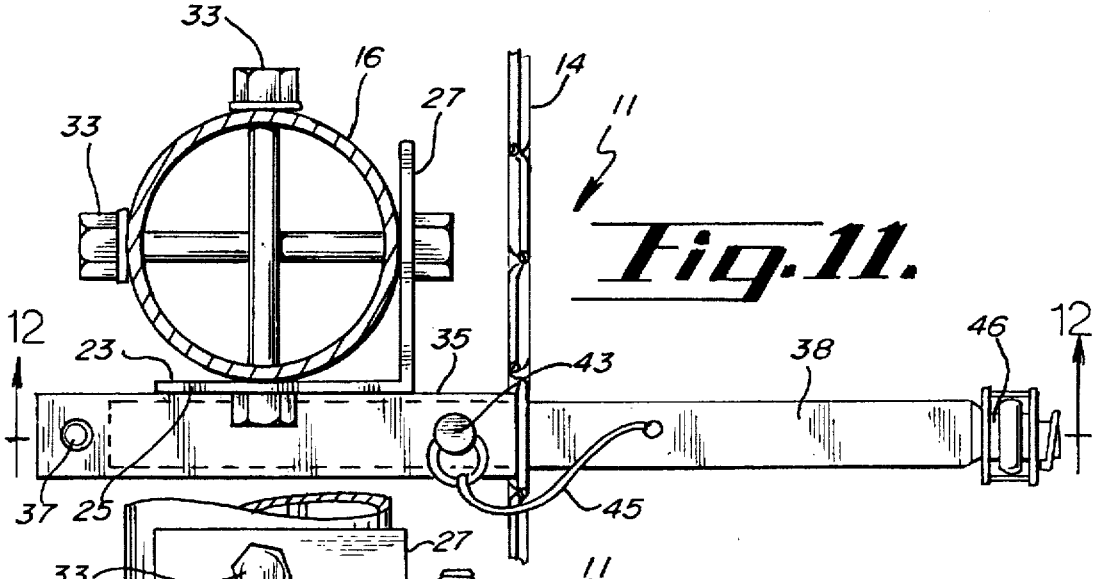
Figure 12:
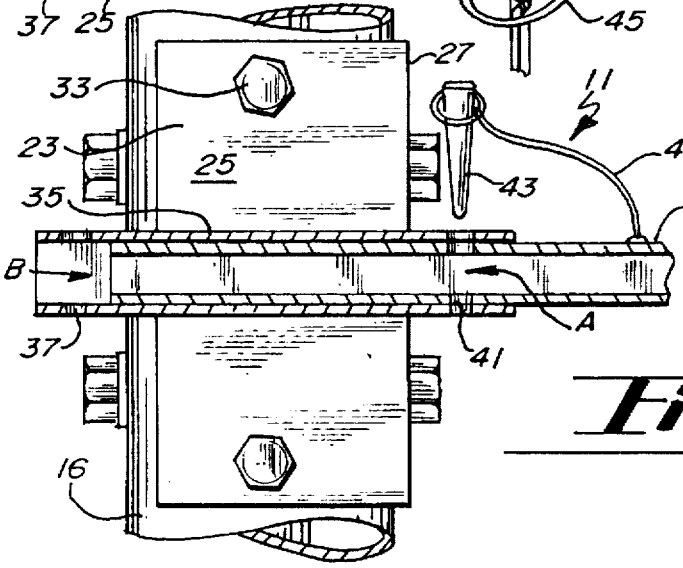
Figure 14:
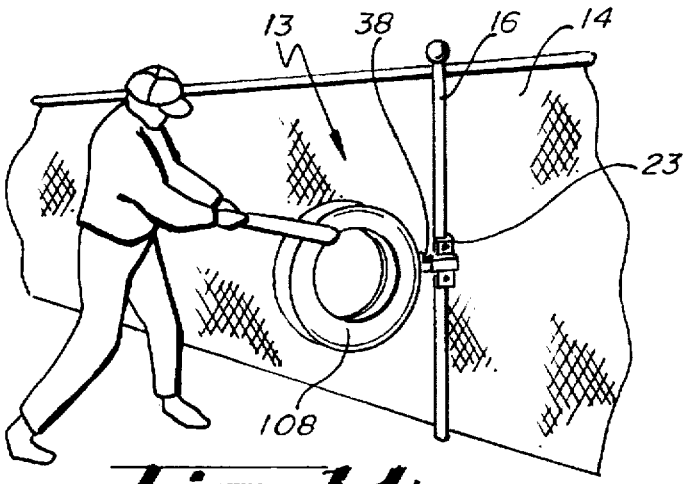
Figure 15:
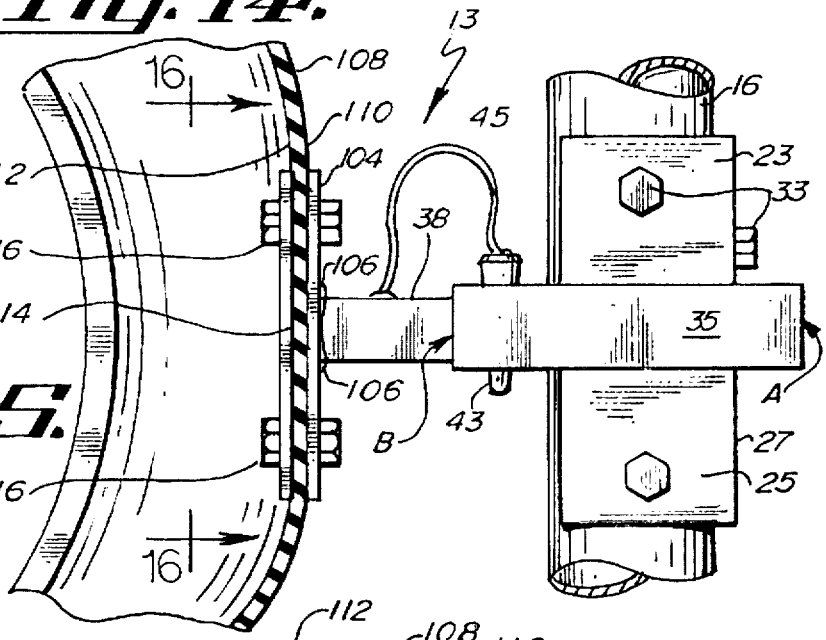
Figure 16:
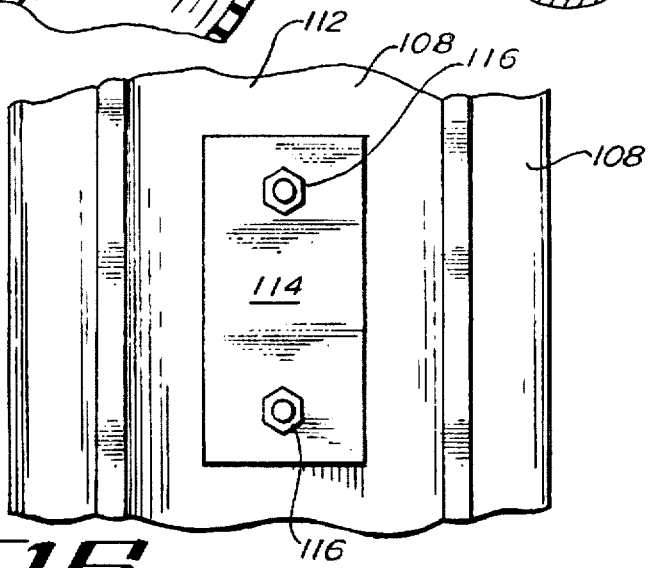
Figure 18:
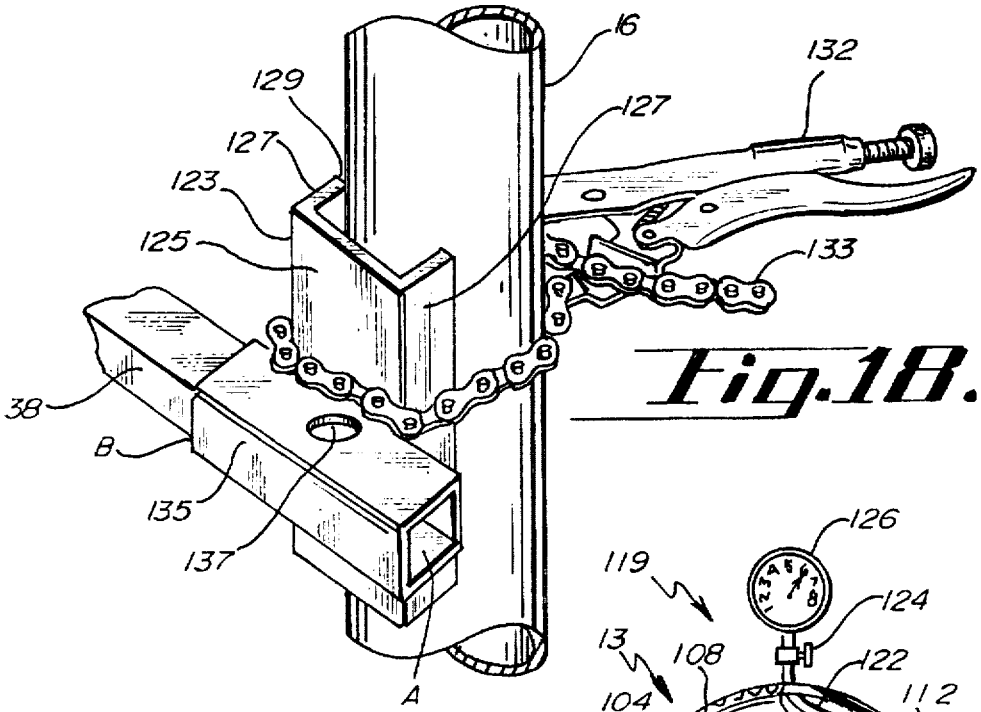
Figure 17:
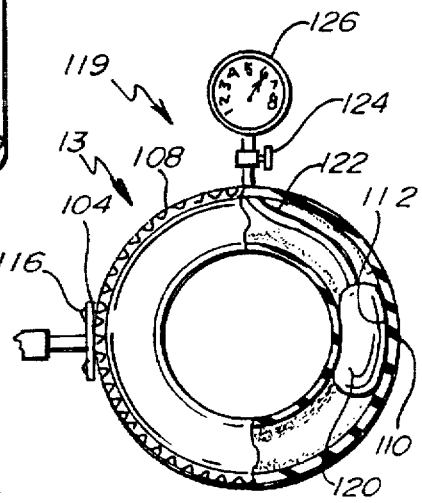

FIG; 10 is a perspective view of the modified device attached to a fence post;

FIG.11 is a top plan view of the modified device attached to a fence post which is partially broken away;

FIG. 12 is a cross sectional view taken along lines 12—12 of FIG. 11;

FIG. 13 is an enlarged broken away view of the locking means of the modified device;

FIG. 14 is a perspective view of the batting practice device with tire attached to a fence post for batting practice;

FIG. 15 is a side elevational view partially broken away to show detail; and FIG. 16 is a view taken along lines 16—16 of FIG. 15;

FIG. 17 is a perspective view of the receiving tube with an expandable modified mounting bracket and pipe grip completely removable from the permanent fixture;

FIG. 18 is a top plan view of the modified device of FIG. 17; and

Figure 19:
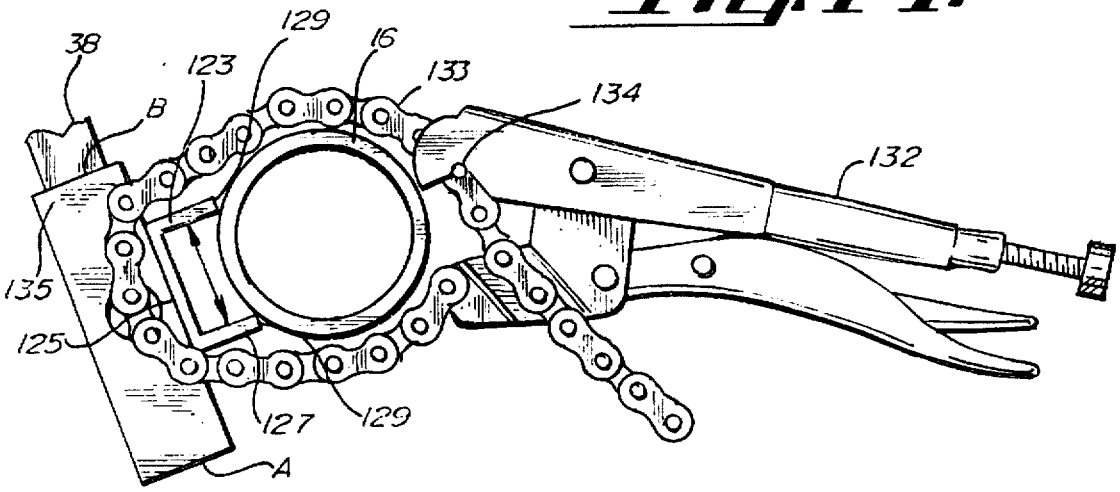

FIG. 19 is an elevational view of the batting practice device with tire and bat striking force measuring apparatus.

DETAILED SPECIFICATION

The batting practice device 10 of the present invention may generally be seen in FIGS. 1–8. The device attaches to some existing permanent fixtures 12 with a vertical surface for suspending the batting practice device 10. The device includes an elongate mount bar 24, mounting plate 32, pipe 38, metal bushing 46, braided rope 56 and ball 68.

While the detailed structure assembly and operation of the batting practice device 10 is clearly shown in FIGS. 1–3A, samples of permanent fixtures 12 are shown in FIGS. 4–7. Examples of permanent fixtures might include a fence 14, posts 16, building 18, trees 20 and an interior wall 22.

More specifically, the batting practice device 10 includes an elongate mount bar 24 suitably made of a "2×4" board 26 approximately four feet in length. The bar 24 may be made of a variety of materials but Applicant has found that the wooden board 26 readily absorbs the impact, shock, vibration and energy forces which a batter will transfer from his bat (FIG. 1) to the device which otherwise may be transferred to the permanent fixture 12.

The mount bar 24 is appropriately releasably affixed or attached to the permanent fixture 12 by way of six inch hanger bolts 28 or the like. The bolts 28 are appropriately attached to the fixture perhaps in several vertically aligned locations for adjusting the batting practice device 10 either upwardly or downwardly to the strike zone of the user.

Approximately ¾ of the length mount bar 24 is to be mounted flush onto the vertical surface of the permanent fixture 12, where applicable. The bar 24 has apertures therethrough which receive the hanger bolts 28 therethrough. Thereafter washers and wingnuts may be rotatably affixed to the bolts to secure the mount bar 24 to the fixture 12. The mount bar 24 by this arrangement has a bar extending portion 31 approximating ¼ of the length of the overall mount bar 24.

At the bar extending portion 31 is appropriately affixed a mounting plate 32 which suitably is made of a zinc-plated heavy gauge steel. The plate 32 appropriately may be affixed to the bar extending portion 31 by way of screws, bolts or the like 36 at the plate's apertures 34.

Suitably affixed to the mounting plate 32, such as by welding, is a zinc-plated heavy gauge steel rod or pipe 38 which has a pipe extending portion 39 and an aperture 40 through the end of that portion 39. The aperture 40 receives a locking lynch pin 42 while intermediately of the pipe extending portion 39 is a stop washer 44 which is welded to the pipe 38.

A metal bushing 46 is also appropriately made of a zinc-plated heavy gauge steel. The metal bushing 46 may have grease 48 on its inner side for a low friction fit and to add lubrication as the bushing 46 is slid over and rotated on the pipe extending portion, stopped by the stop washer 44 and locked into place the lynch pin 42. The metal bushing 46 preferably has a first loop, ring or eyelet 50 and a generally opposing second loop, ring or eyelet 52 as will be appreciated. Between the bushing 46 and the lynch pin 42 is appropriately located a fender washer 54 to prohibit wear of the pin 42 by the friction of the rotating metal bushing 46.

A braided plastic rope 56 is utilized with this invention and is suitably made of a plastic, nylon or polypropylene material with interweave strands 58. A braided rope 56 of this type typically has a hollow core 60. The rope 56 may have a first end 62 and a second end 64. The rope is to pass through the central aperture 66 of a ball 68, suitably of the equivalent weight of a softball or baseball and appropriately made of ethylene vinyl acetate. The braided rope 56 appropriately is protected by a first vinyl sheath 70 located just above the ball 68 and second vinyl sheath rope guard or protector 72 which surrounds the braided rope at the metal bushing 46 area.

Figure 3:
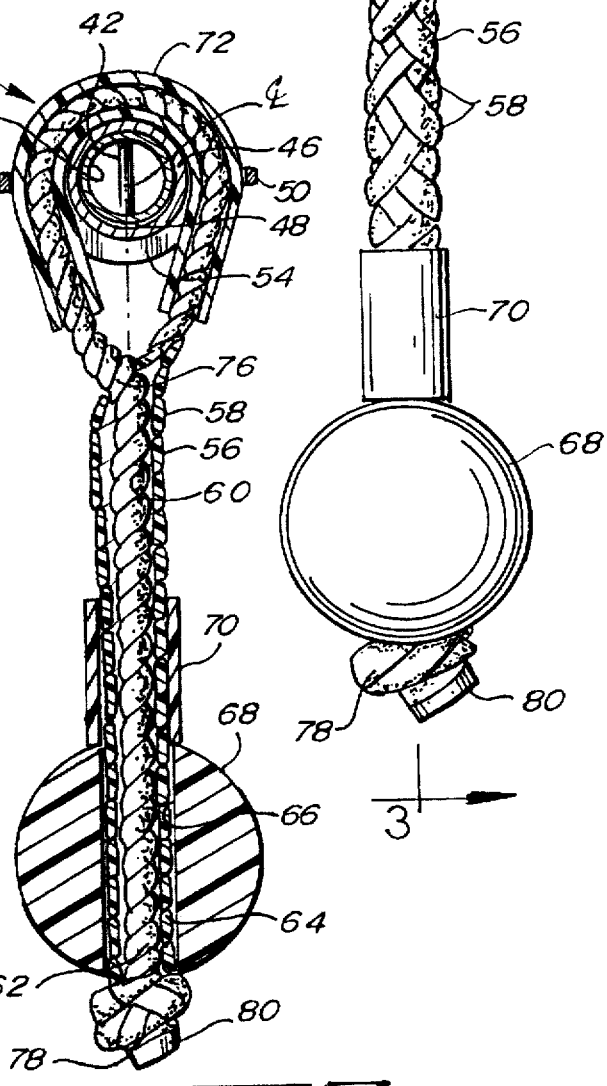
FIG. 3 is a cross-sectional view taken along lines 3—3 of FIG. 2.
Figure 3A:
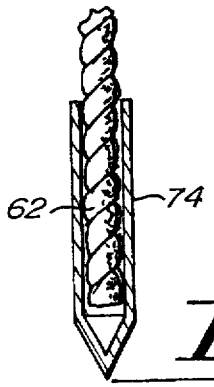
FIG. 3A is a front elevational view of the guide tool utilized in constructing the present invention.

Referring to FIGS. 3 and 3A, the assembly of the batting practice device 10 may be understood. The first end 62 of braided rope 56 is initially fed through the central apertures 66 of the ball 68. Thereafter the first vinyl sheath 70 is threaded over the first end 62 and slid downwardly to abut the ball 68. The first end 62 is then thread through the second vinyl sheath 72 which together with the braided rope is passed over the metal bushing 46 and through the first and second loops or rings 52. Thereafter, the first end 62 is inserted into the pointed hollow needle or guide tool 74. The pointed tool 74 is then inserted into the hollow core 60 of the braided rope 56 between the interweaved strands 58. The first end is guided along and within the hollow core as it is passed through the central aperture 66 of ball 68. Thereafter a knot 78 if formed suitably at the first 62 and second 64 ends after which the ends are heat sealed 80 together.

Next the lynch pin 42 is removed from the end of pipe 38. The metal bushing 46 is slid onto the pipe extending portion 39 up to the stop washer 44. Thereafter, fender washer 44 is slid onto pipe 38 and lynch pin 42 is again locked onto the pipe 38. The invention thereafter is assembled excepting only the affixation of the mounting plate 32 onto the elongate mount bar 24 or board 26 which in turn is affixed to a permanent fixture 12.

FIGS. 1 and 4 through 7 illustrate the various permanent fixtures 12 that the batting practice device 10 may be releasably connected thereto. It is appropriate to note that a plurality hanger bolts 28 may be vertically aligned as to move the elongate bar 24 either upwardly or downwardly to position the ball 68 in the strike zone of the batting operator.

Figure 1:
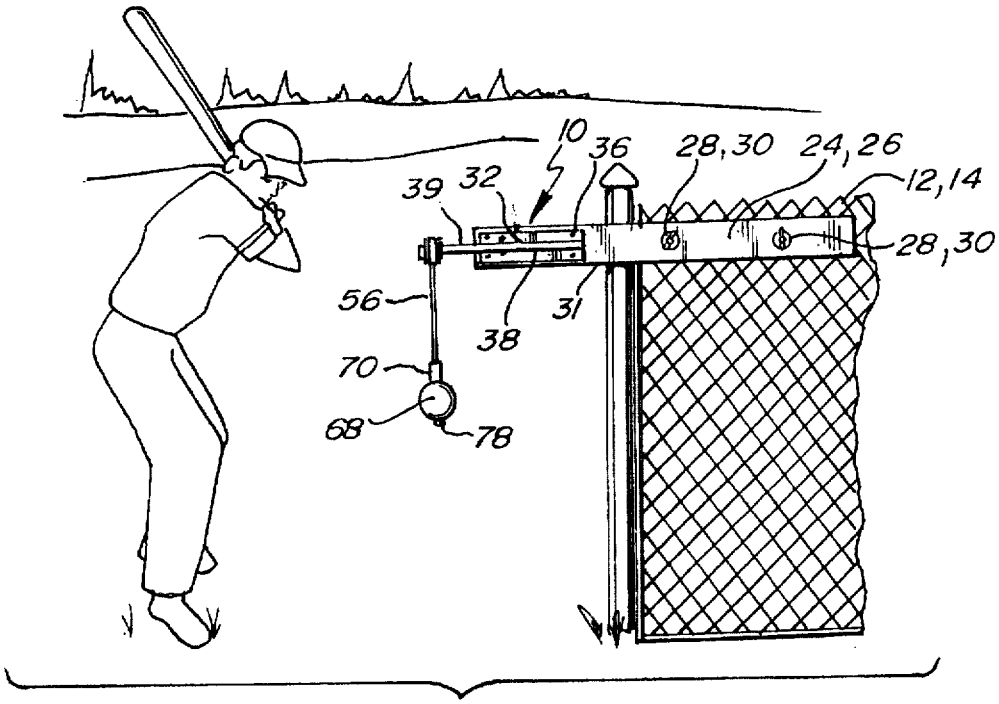
FIG. 1 is a front elevational view of the batting practice device of the present invention being utilized by a batter as the device is affixed to a fence.
Figure 4:
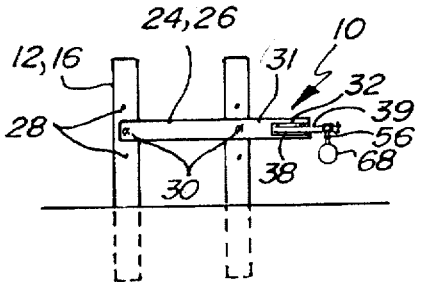
FIG. 4 is a front elevational view of the batting practice device mounted on fence posts.
Figure 5:
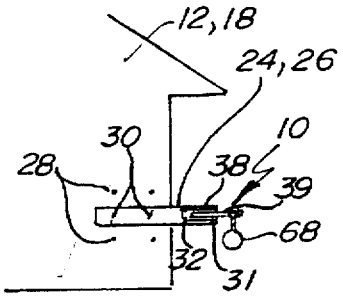
FIG. 5 is a front elevational view of the batting practice device mounted on an exterior wall of a building.
Figure 6:
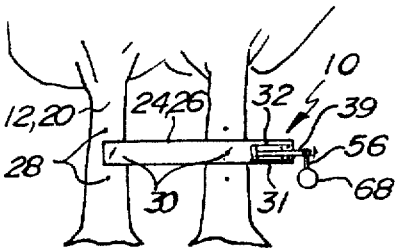
FIG. 6 is a front elevational view of the batting practice device mounted on to two adjacent trees.

Referring to FIG. 1, the batting operator, and perhaps a coach, can observe the rotation of the ball 68 and tell if the hit was popped up, pushed, pulled or slugged hard and straight forward from either behind or in front of the operator.

Figure 7:
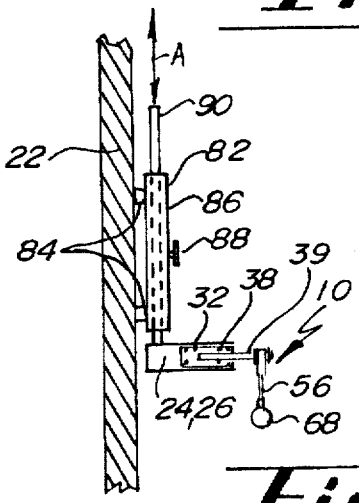
FIG. 7 is a front elevational view of the batting practice device mounted on the interior side of a wall shown in cross-section.
Figure 2:
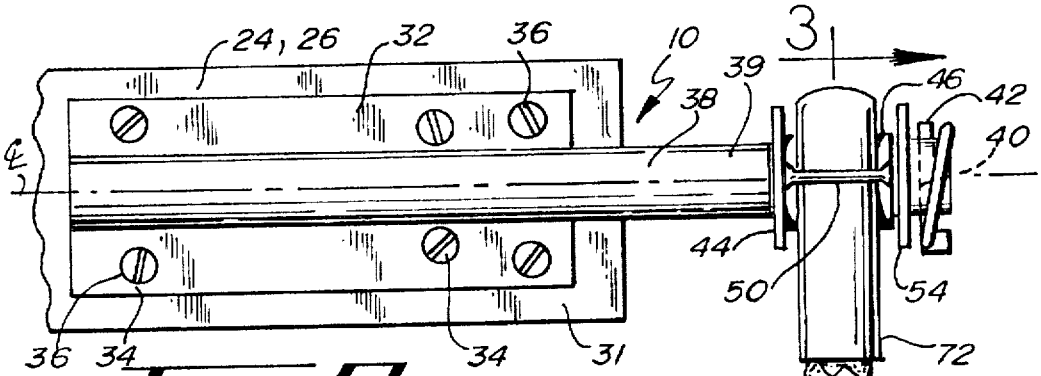
FIG. 2 is a front elevational view of the present invention with the elongate mounting bar broken away.

FIG. 7 shows an adjustable wall mount 82 for the inside of a building such as a gym. Hanger bolts or studs 84 are affixed into the wall 22. The bolts or studs 84 appropriately support an outer tube or sleeve 86 in a secure manner. Sleeve 86 supports a set screw with a handle 88. A device support rod 90 passes through the sleeve 86 and is adjustably held in vertical position by the inward turning of the set screw 88. Arrow A illustrates that the device support rod 90 may be moved upwardly or downwardly to appropriately position the ball 68 in the user's strike zone.

Figure 8:
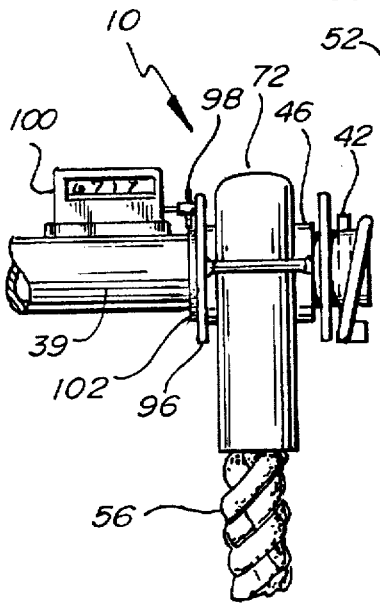
FIG. 8 is a front elevational view of the batting practice device partially broken away showing a revolution counter mechanism mounted thereon.

Referring to FIG. 8, the present invention may be fitted with a counter 94. Counter 94 is appropriately affixed to the pipe 38 adjacent a collar or washer 102 which takes the place of former stop washer 44. In place of former stop washer 44, a washer 96 is fixed to bushing 46 and supports a cog 98. As bushing 46 rotates about pipe 38, the cog 98 extending from washer 96 engages the sprocket of counter 100.

By this arrangement, the user or batting practitioner may count the number of revolutions of both the ball 68 and the bushing 46 to ascertain the force that the user has hit the ball 68. It is also appropriate that ball 68 be of substantially the same weight as a real baseball or softball to give the user the sensation of actually hitting a real ball.

Referring to FIGS. 9–13, a modified batting practice device 11 may be viewed. Device 11 is suitably mountable on a fence 14 appropriately about a post 16. Mount means may include a mount bar 24, mounting plate 32 and rod 38, as previously discussed, or mounting bracket 23, receiving tube 35 and rod 38.

More specifically, the modified device 11 would include an angle iron piece portion described as a mounting bracket 23. The mounting bracket has a face side 25 and a sidewall side 27 appropriately at 90° from each other. The face 25 and sidewall 27 suitably have alignable and opposing apertures 29 to receive four arrangements of bolt and nuts 33 to securely fasten the mounting bracket 23 to post 16 by eight secure points.

Mounting bracket 23 supports a receiving tube 35 having two openings A and B. Receiving tube 35 also has vertically oriented apertures 37 which are suitably canted or beveled and larger on the top portion of tube 35 than on the bottom portion. One aperture 37 is suitable.

A rod 38 is slidably receivable within receiving tube 35 either from opening A or B depending upon the user's preference. The rod 38 also has apertures 41 therethrough which are suitably canted or beveled and of a slightly smaller diameter than apertures 37 of the receiving tube 35 for a perfectly alignable arrangement. A locking pin 43 suitably is tapered to the same degree as the bevelling of apertures 37 and 41. By this arrangement, locking pin 43 will securely fit within apertures 37 and 41 in an arrangement that will not loosen with time but will remain secure through extended use as the locking pin 43 further seats within apertures 37 and 41. An attachment means 45, suitably a cord or a chain, secures the locking pin 43 to the rod 38 as to prevent its loss.

Rod 38 also appropriately has a metal bushing 46 supporting a rope 56, ball 68 and vinyl sheath 72 as previously described. By this arrangement, the user may place the batting practice device 11 in one of at least two directions with respect to openings A and B in tube 35.

Referring to FIGS. 14–16, a modified batting practice device with fire 13 may be viewed. Device 13 is suitably mountable on a fence 14 appropriately about a post 16. Mount means may include an angle iron piece portion described as a mounting bracket 23. The mounting bracket 23 has a face side 25 and a side wall side 27 appropriately as 90° from each other. The face 25 and side wall 27 suitably have alignable and opposing apertures 29 to receive four arrangements of bolts and nuts 33 to securely fasten the mounting bracket 23 to post 16 by eight secure points.

Mounting bracket 23 supporting a receiving tube 35 having two openings A and B. Receiving tube 35 also has vertically oriented apertures 37 which are suitably canted or beveled and larger on the top portion of the tube 35 than on the bottom portion.

A rod 38 is slidably receivable within receiving tube 35 either from opening A or B depending upon the user's preference. The rod 38 also has apertures 41 (not shown) therethrough which are suitably canted or beveled and of a slightly smaller diameter than apertures 37 of the receiving tube 35 for a perfectly alignable arrangement. A locking pin 43 suitably is tapered to the same degree as the beveling of apertures 37 and 41. By this arrangement, the locking pin 43 will securely fit within apexlures 37 and 41 in an arrangement that will not loosen with time but will remain secure through extended use as the locking pin 43 fully seats within apertures 37 and 41. An attachment means 45, suitably a cord or a chain, secures the locking pin 43 to the rod 38 as to prevent its loss. In almost all respects, the described batting practice device with tire 13 is similar to the device 11 previously described. With respect to this modified device 13, a first metal support plate 104 is transferably mounted at the end of rod 38 suitably by weldments 106. A tire 108 has a tread face 110 and an inside wall 112. The first metal support plate 104 abuts the tread face 110 while a second metal support plate 114 is aligned with the first plate 104 but abutting and adjacent to the inside wall 112 of the tire 108. Fastening means or bolts and nuts 116 suitably may then pass through the respective plates 104 and 114 as to sandwich the tire 108 in a secure manner.

In operation, the mounting bracket 23 and receiving tube 35 are similar for both devices 11 and 13. With the removal of device 11 is first accomplished in the batting practice device with tire 13 may be inserted into the mounting bracket 23 in its place. More specifically, the tire 108 secured by plates 104 and 114 with rod 38 is brought towards mounting bracket 23. Rod 38 is guided into receiving tube 35 into either openings A or B, afterwhich locking pin 43 is secured. Thereafter, the individual may begin batting practice by striking the immobilized tire 108 securely held by the described arrangement. The removal of the tire batting device 13 is simply accomplished by the withdrawing of the locking pin 43 and removal of the rod 38 from receiving tube 35.

Referring to FIG. 17, the batting practice device with tire 13 may further include a bat striking force measuring apparatus 119. The apparatus 119 includes a bladder 120 filled with air or fluid. The bladder 120 is in flow communication via a hose 122 and a check valve 124 with a pressure gauge 126.

In operation, the batter strikes the tread face 110 of the immobilized tire 108. The force is then transferred inwardly to then compress the bladder 120. Next, the pressure or force is fed through hose 122, through check valve 124 to the pressure gauge 126 which will measure the impact of the bat striking force. The check valve 124 will permit the pressure gauge 126 to remain at its measuring point. The batter then simply releases the check valve 124 for another measured bat strike upon the tire 108.

Referring to FIGS. 18 and 19, a modified expandable mounting bracket 123 may be seen that is easily and readily affixable to a post 16. The mounting bracket 123 is completely removable from the post 16 without leaving any components affixed to the post 16. More specifically, an expandable mounting bracket 123 is utilized that is generally U-shaped in cross section having a face 125 and side walls 127. A pipe grip 132 (similar to a vice grip), has a chain 133 and a catch 134 for tightening and securing the chain about the bracket 123 and post 16. As the pipe grip 132 is tightened, side walls 127 expand (double-headed arrow in FIG. 15) and side wall ends 129 bite into the post 16 to securely and portably secure the batting practice device to post 16.

On face 125 of mounting bracket 123 is secured, suitably by welding, a receiving tube 135 having openings A and B. Receiving tube 135 also has an aperture 137 therethrough. Rod 138 appropriately is slidably receivable in openings A or B and may have an aperture (41 shown in FIG. 9) which is alignable with aperture 137 in the receiving tube after which an interlockable pin 43 (FIG. 9) may be secured.

This second mounting bracket 123 makes the batting practice device with tire 13 completely portable without securing any components permanently to a post 16. This structure is highly desirable for a coach who travels with his equipment to various locations for teaching young baseball players.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A batting practice device, comprising:

(a) a vertical permanently fixed post;

(b) a mount bracket immovably attachable to said post, the bracket supporting a receiving tube;

(c) a rod receivable in said tube and interlockable therein by a pin and apertures arrangement, the rod having a portion extending from said mount bracket in a cantilevered horizontal fashion, said tube and rod being substantially parallel to each other;

(d) a first metal support plate transversely mounted on said rod portion extending from said mount bracket;

(e) a tire with a tread face and an inside wall, the tread face abutting the metal plate;

(f) a second metal support plate on the inside wall aligned with the first plate as to sandwich the tire; and (g) fastening means to secure the plates together sandwiching the tire in a stationary position for hitting the tread face of the tire with a bat.

2. The batting practice device of claim 1, wherein the fastening means are nuts and threaded bolts.

3. The batting practice device of claim 2 wherein the mounting bracket is expandable and U-shaped to engage the post and further comprising a pipe grip with a chain for expanding and securing the mounting bracket onto the post.

4. The batting practice device of claim 1, further comprising a bat striking force measuring apparatus.

5. The batting practice device of claim 4 wherein the bat striking force measuring apparatus comprises a bladder along the inside wall connected to a gauge with a hose.

* * * * *